US007303436B1

(12) United States Patent
Li

(10) Patent No.: US 7,303,436 B1
(45) Date of Patent: Dec. 4, 2007

(54) CABLE CONNECTOR THAT PROHIBITS THE CABLE FROM ROTATION

(75) Inventor: Ching-Chieh Li, Taichuang County (TW)

(73) Assignee: Cablesat International Co. Ltd., Taichung (TW)

( * ) Notice: Subject to any disclaimer, the term of this patent is extended or adjusted under 35 U.S.C. 154(b) by 0 days.

(21) Appl. No.: 11/650,505

(22) Filed: Jan. 8, 2007

(30) Foreign Application Priority Data

Oct. 16, 2006 (TW) ..... 95138127 A

(51) Int. Cl.
*H01R 9/05* (2006.01)

(52) U.S. Cl. ..... 439/578

(58) Field of Classification Search ..... 439/578, 439/585, 589, 586
See application file for complete search history.

(56) References Cited

U.S. PATENT DOCUMENTS 7,018,235 B1 * 3/2006 Burris et al. ..... 439/584
7,128,603 B2 * 10/2006 Burris et al. ..... 439/578
7,179,122 B2 * 2/2007 Holliday ..... 439/585
2004/0147164 A1 * 7/2004 Li ..... 439/578

* cited by examiner

*Primary Examiner*—Phuong Dinh
(74) *Attorney, Agent, or Firm*—Browdy and Neimark, PLLC

(57) ABSTRACT

A cable connector capable of prohibiting the cable from rotation, comprising: a tubular casing having a coupling portion at one end and a tapered abutment portion disposed at the other end and a plurality of toothed portions spaced around the inside wall near the tapered abutment portion, a locknut rotatably coupled to the coupling portion of the tubular casing, a inner tube inserted into the locknut and the tubular casing, and a collar, which has a clamping portion at one end and attached to the tapered abutment portion of the tubular casing, a receiving portion at the other end for the insertion of a cable into the collar and the casing and the inner tube, and a tapered surface portion gradually reducing from the clamping portion toward the receiving portion for allowing the collar to be forced onto the tubular casing by an external push force to compress the tubular casing radially inwards toward the inner tube, thereby securing firmly the inserted cable to the inner tube and the tubular casing.

6 Claims, 3 Drawing Sheets

CABLE CONNECTOR THAT PROHIBITS THE CABLE FROM ROTATION

BACKGROUND OF THE INVENTION

1. Field of the Invention

The present invention relates to cable connection devices and more particularly, to a cable connector that prohibits the cable from rotation.

2. Description of the Related Art

Regular cable connectors commonly have a clamping or anti-escape structure to secure the inserted cable, preventing disconnection of the inserted able. The clamping or anti-escape structure is an annular design that prohibits the inserted cable from axial displacement, however it cannot prohibits the inserted cable from rotation.

SUMMARY OF THE INVENTION

The present invention has been accomplished under the circumstances in view. It is one object of the present invention to provide a cable connector, which accurately secures the inserted cable, prohibiting the cable from rotation.

To achieve this object of the present invention, the cable connector is comprised of a tubular casing, a locknut coupled to one end of the tubular casing for mounting, an inner tube inserted through the locknut into the tubular casing, and a collar forcible onto the tubular casing by an external push force to compress the tubular casing radially inwards toward the inner tube after insertion of a casing into the tubular casing and the inner tube, thereby causing inside protruding teeth of the tubular casing to engage the inserted cable.

DETAILED DESCRIPTION OF THE INVENTION

Referring to FIGS. 1~4, a cable connector in accordance with the present invention is shown comprised of a casing 10, a locknut 20, an inner tube 30, and a collar 40.

Figure 1:
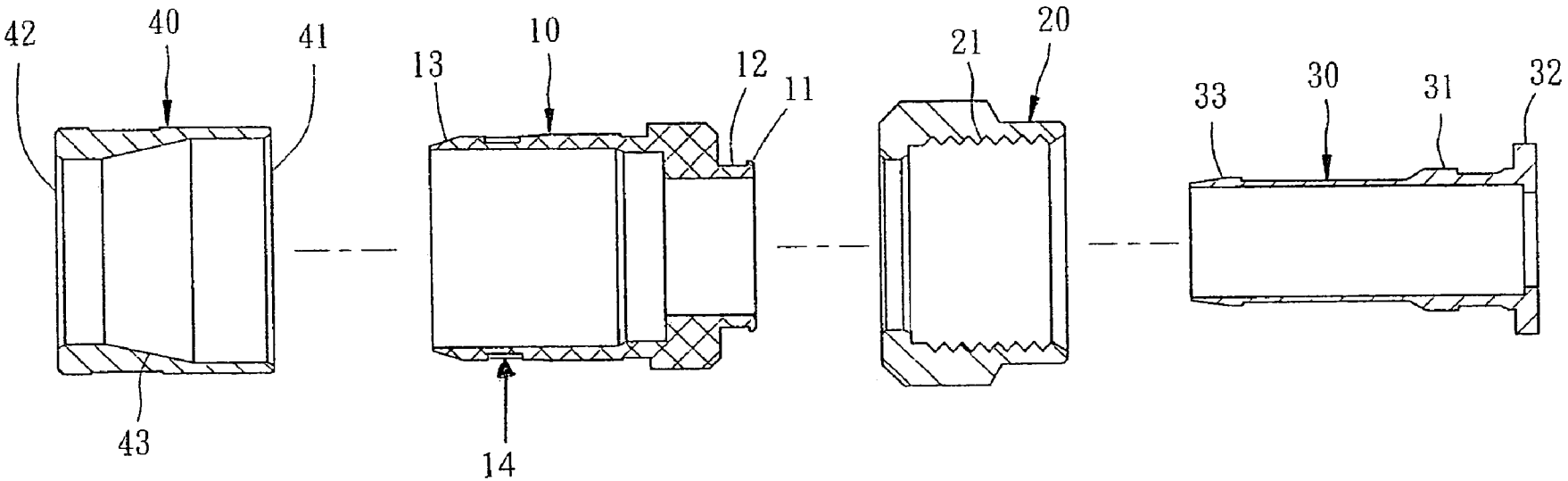
FIG. 1 is an exploded view in section of a cable connector according to the present invention.
Figure 2:
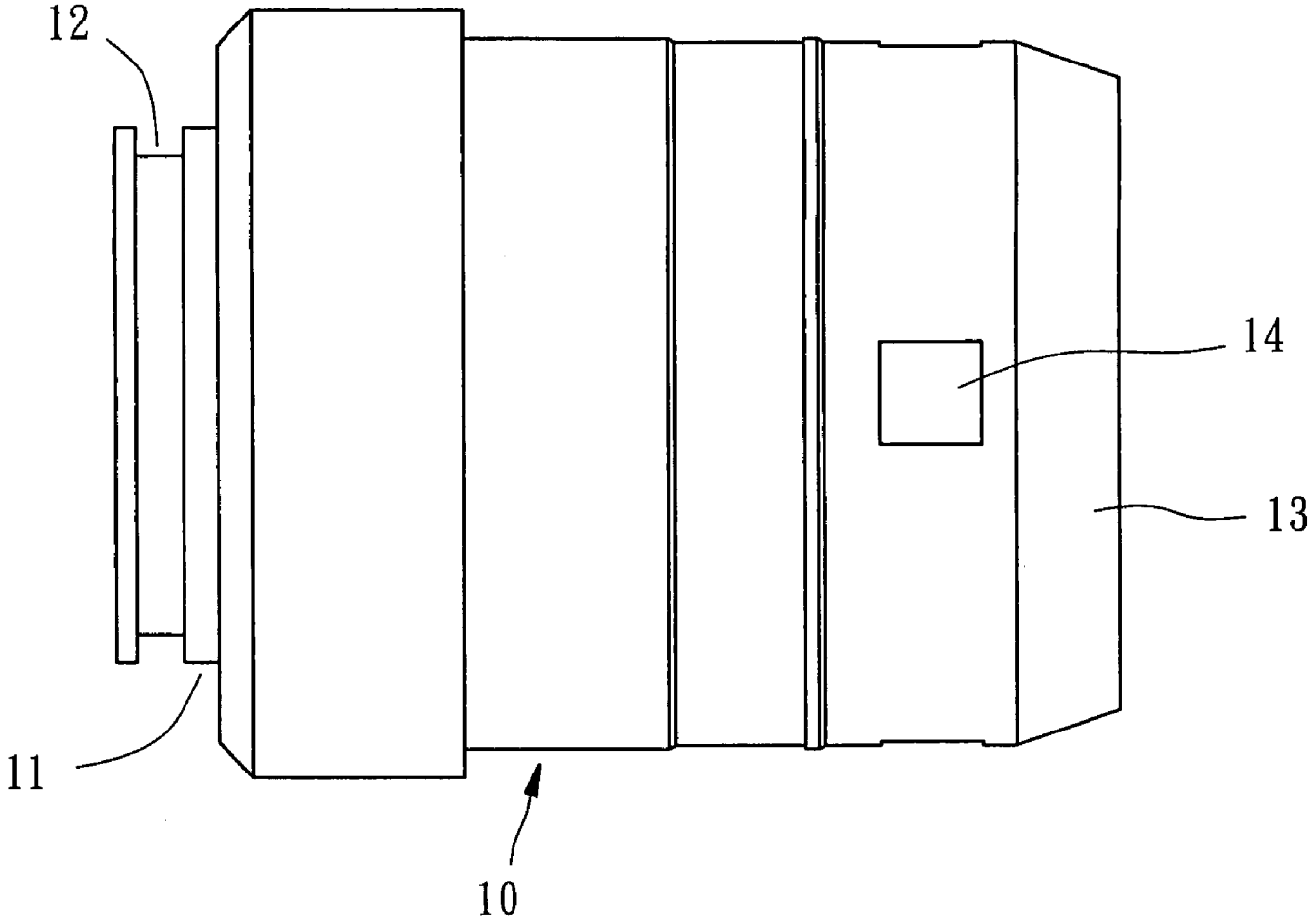
FIG. 2 is a side view of the casing of the cable connector according to the present invention.
Figure 3:
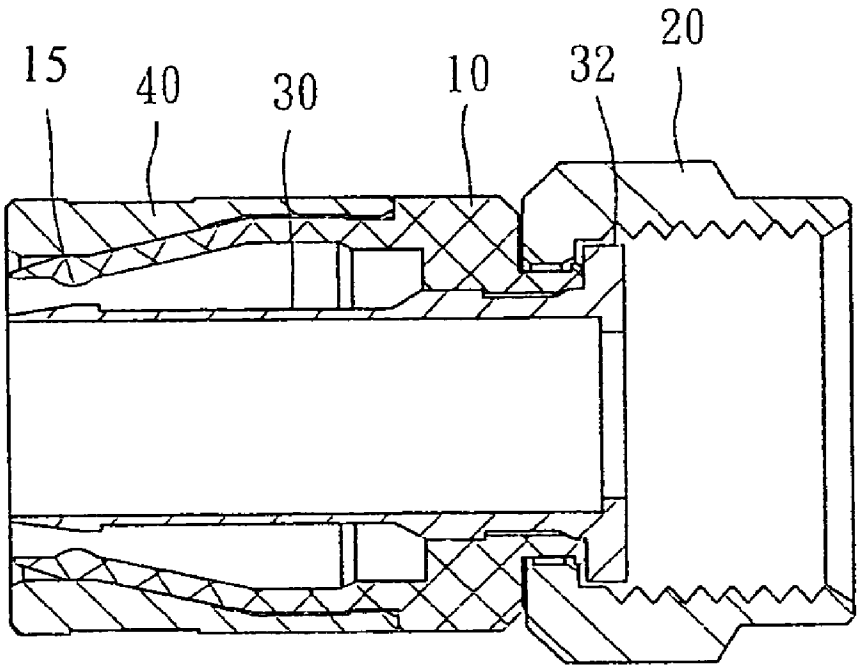
FIG. 3 is a sectional side view of the cable connector according to the present invention.
Figure 4:
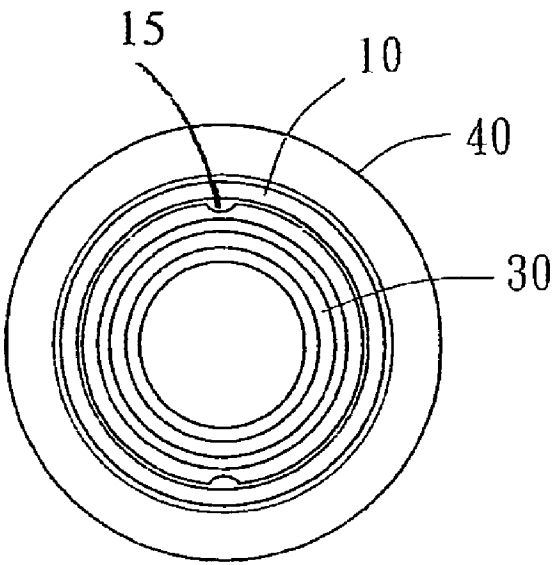
FIG. 4 is an end view of FIG. 3.

The casing 10 is a tubular member having a front coupling portion 11 with a smaller inner diameter, an outside annular groove 12 extending around the periphery of the front coupling portion 11 for holding a gasket ring (not shown), a tapered abutment portion 13 disposed at the rear side and reducing outside diameter gradually backwards, and plurality of deformable portions, for example, two thin wall portions 14 disposed adjacent to the tapered abutment portion 13, as shown in FIG. 3. The front coupling portion 11 has an inner diameter relatively smaller than the casing 10.

The locknut 20 is rotatably coupled to the front coupling portion 11 of the casing 10, having an inner thread 21.

The inner tube 30 is inserted into the casing 10 and the locknut 20, having a stop flange 32 extended around the periphery of one end, namely, the front end, a barbed portion 33 extending around the periphery of the other end, namely, the rear end, and a protruded engagement portion 31 extending around the periphery between the stop flange 32 and the barbed portion 33. The barbed portion 33 is protruded radially outwards from the periphery of the inner tube 30 to define with the periphery of the inner tube 30 an elevational difference and then gradually reducing toward the rear end of the inner tube 30.

The collar 40 has an inner diameter divided into a relatively greater clamping portion 41 at one end, a relatively smaller receiving portion 42 at the other end, and a tapered surface portion 43 gradually reducing from the relatively greater clamping portion 41 toward the relatively smaller receiving portion 42. The collar 40 is attached to the tapered abutment portion 13 of the casing 10, and can be moved onto the casing 10 by an external force.

When in use, the cable is inserted into the receiving portion 42. At this time, the casing 10 receives no pressure from the collar 40, i.e., the inside wall of the casing 10 is maintained smooth, and there is a big tubular space left between the outside wall of the inner tube 30 and the inside wall of the casing 10, and therefore the cable can conveniently be inserted into the cable connector. After insertion of the cable into the cable connector, the inner lead wires and the related insulator of the cable are kept inserted into the inner tube 30, and the outer wrapping layer of the cable is engaged into the tubular space between the outside wall of the inner tube 30 and the inside wall of the casing 10.

Thereafter, a push force is applied to the collar 40 to force the collar 40 onto the casing 10. At this time, the clamping portion 41 of the collar 40 compresses the casing 10 radially inwards to force the tapered abutment portion 13 radially inwards against the periphery of the inner tube 30, thereby shortening the distance outside wall of the inner tube 30 and the inside wall of the casing 10, and therefore the outer wrapping layer of the cable is firmly secured to the inner tube 30 and the inside wall of the casing 10. At the same time, the deformable portions 14 of the casing 10 permit the tapered abutment portion 15 to be forced toward the inside of the casing 10, so that the respective protruding teeth 15 engage the outer wrapping layer of the cable and prohibit axial displace and rotation of the cable relative to the cable connector.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. A cable connector comprising a tubular casing, said tubular casing having a coupling portion extending forward axially from a first end thereof, a tapered abutment portion disposed at a second end thereof, and a plurality of protruding teeth which are convex circular projections spaced around an inside wall thereof extending inward from the inner wall of said tapered abutment portion;

a locknut rotatably coupled to said coupling portion of said tubular casing, said locknut having an inner thread for fastening to an external device;

a inner tube inserted into said locknut and said tubular casing; and a collar, said collar having a clamping portion at one end thereof, a receiving portion at an opposite end thereof for the insertion of a cable into said collar and said casing and said inner tube, and a tapered surface portion gradually reducing from said clamping portion toward said receiving portion, said clamping portion having an inner diameter relatively greater than said receiving portion, said clamping portion being attached to said tapered abutment portion, wherein when said collar is forced onto said tubular casing by an external push force, said tubular casing and said plurality of protruding teeth are compressed radially inwards toward said inner tube.

2. The cable connector as claimed in claim 1, wherein the wall of the tubular casing has a plurality of deformable portions spaced around the periphery thereof adjacent to said tapered abutment portion, said deformable portions being forced radially inwards with said plurality of protruding teeth when said collar is forced onto said tubular casing by an external push force to compress said tubular casing radially inwards toward said inner tube.

3. The cable connector as claimed in claim 2, wherein said deformable portions are respectively formed of a wall portion on the periphery of the wall of said tubular casing that is thinner than that of the casing.

4. The cable connector as claimed in claim 1, wherein said tapered abutment portion of said tubular casing has a diameter gradually reducing in direction from the first end of said tubular casing toward the second end of said tubular casing.

5. The cable connector as claimed in claim 1, wherein said coupling portion of said tubular casing has an outside annular groove extending around the periphery thereof to hold a gasket ring.

6. The cable connector as claimed in claim 1, wherein said inner tube has a stop flange extending around the periphery of one end thereof which engages inside said locknut, and a protruded engagement portion extending around the periphery thereof that engages with a part inside said tubular casing.

* * * * *